United States Patent [19]

Adamich

[11] 4,145,731

[45] Mar. 20, 1979

[54] SIMULATED EXTENDABLE AND COLLAPSIBLE EVERGREEN TREE

[76] Inventor: Anthony A. Adamich, 3618 E. 4th St., Duluth, Minn. 55804

[21] Appl. No.: 820,305

[22] Filed: Jul. 29, 1977

[51] Int. Cl.[2] ..... B65D 65/28; G09F 1/08

[52] U.S. Cl. ..... 362/123; 40/124.1; 229/92.8; 362/252; 362/806; 428/9; 428/43

[58] Field of Search ..... 40/124.1, 126 A; 428/7, 428/9, 12, 18, 19, 20, 43, 542, 8, 10; 46/35-37; 229/92.8; 362/123, 252, 806

[56] References Cited

U.S. PATENT DOCUMENTS

| | | | |
|---|---|---|---|
| 1,162,230 | 11/1915 | Foster | 428/9 X |
| 2,108,002 | 2/1938 | Smith et al. | 428/9 X |
| 2,113,038 | 4/1938 | Thalinger | 428/7 |
| 2,587,003 | 2/1952 | Shina | 428/18 X |
| 2,757,472 | 8/1956 | Corwin | 428/18 X |
| 2,841,901 | 7/1958 | Maple | 428/20 X |
| 4,055,690 | 10/1977 | Patterson | 428/9 |

FOREIGN PATENT DOCUMENTS

| | | | |
|---|---|---|---|
| 174694 | 4/1935 | Switzerland | 428/9 |
| 269205 | 10/1950 | Switzerland | 428/7 |
| 820907 | 9/1959 | United Kingdom | 428/9 |
| 827400 | 2/1960 | United Kingdom | 428/9 |

*Primary Examiner*—Henry F. Epstein
*Attorney, Agent, or Firm*—Wicks & Nemer

[57] ABSTRACT

A simulated extendable and collapsible evergreen tree including a flat support sheet having a cut formed therethrough starting at a point removed from the center of the support sheet and proceeding inwardly of the sheet in a circular formation in an ever decreasing diameter to form a spiral connected to the support sheet with a central formation having a socket. The flat support is mounted on a base member which has a socket mounted centrally thereof. A rod is engaged at one end in the socket of the central formation and at the other end in the socket on the base member thereby supporting the spiral in extended condition.

2 Claims, 10 Drawing Figures

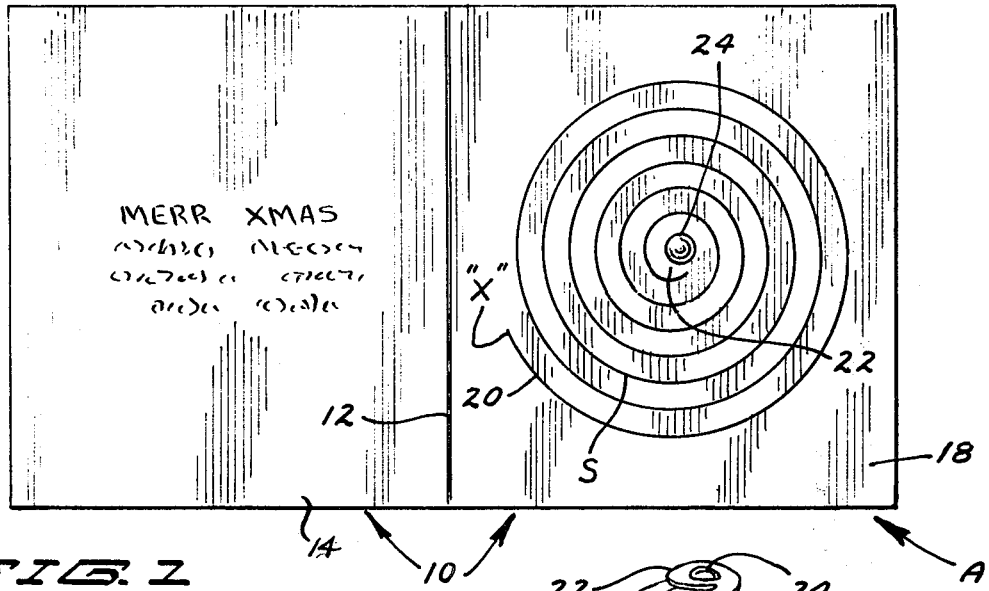
FIG. 1
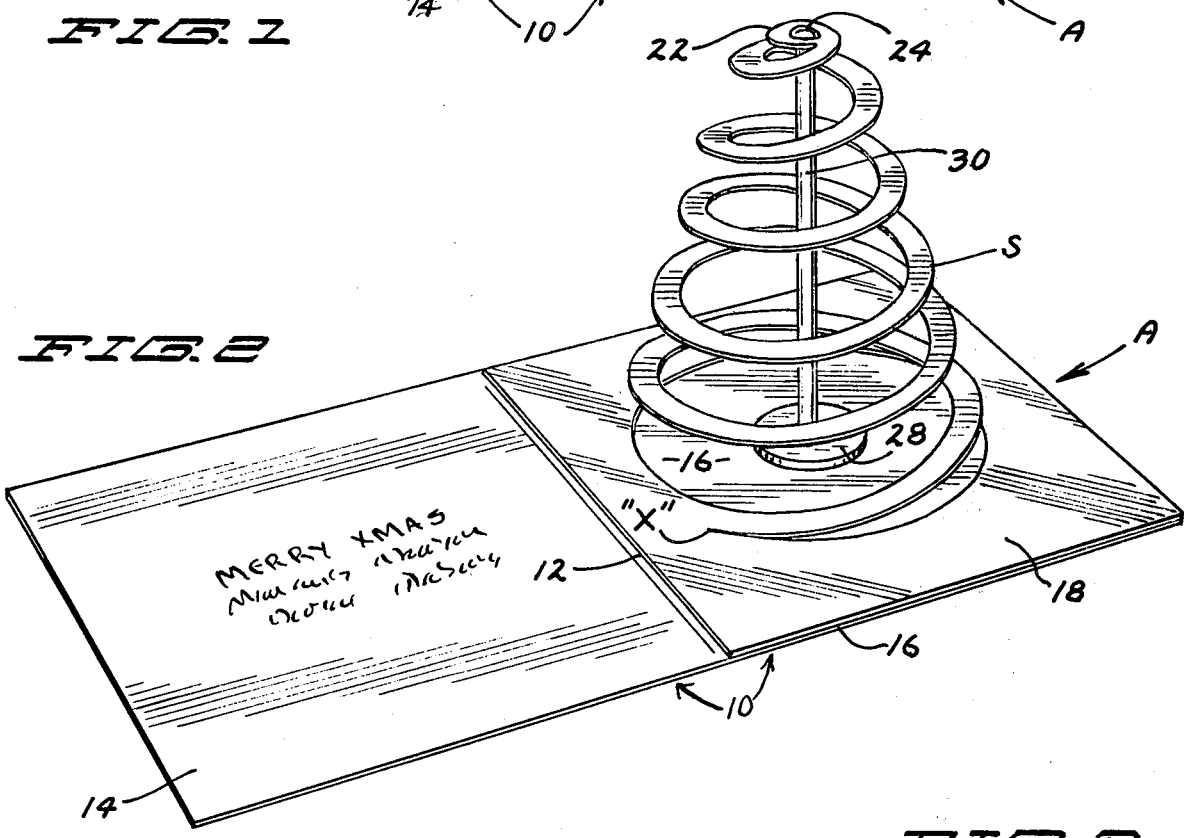
FIG. 2
FIG. 3
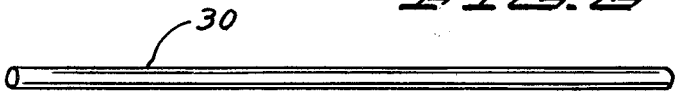
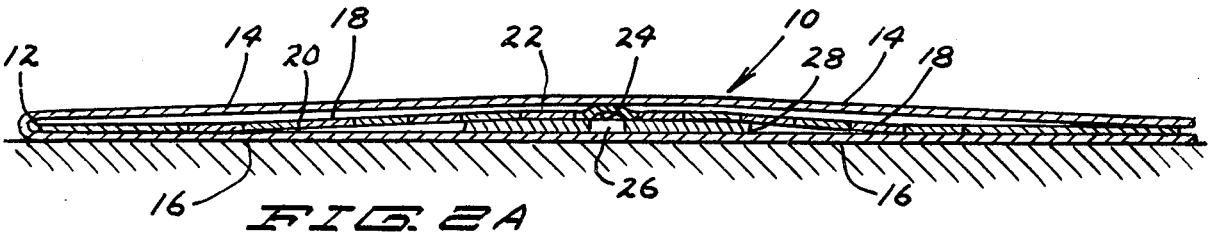
FIG. 2A

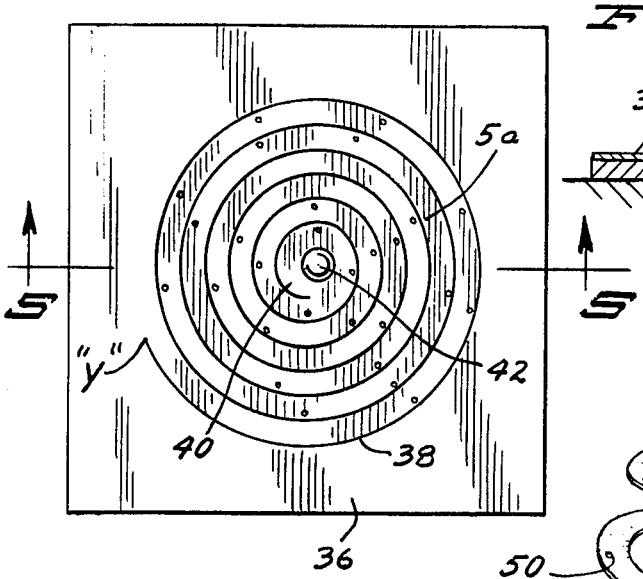
FIG. 4
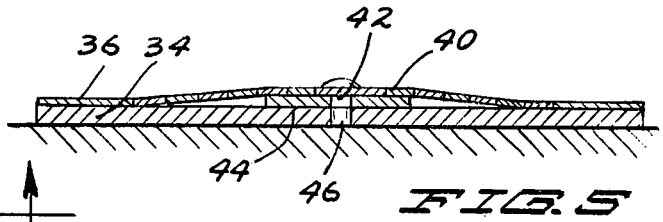
FIG. 5
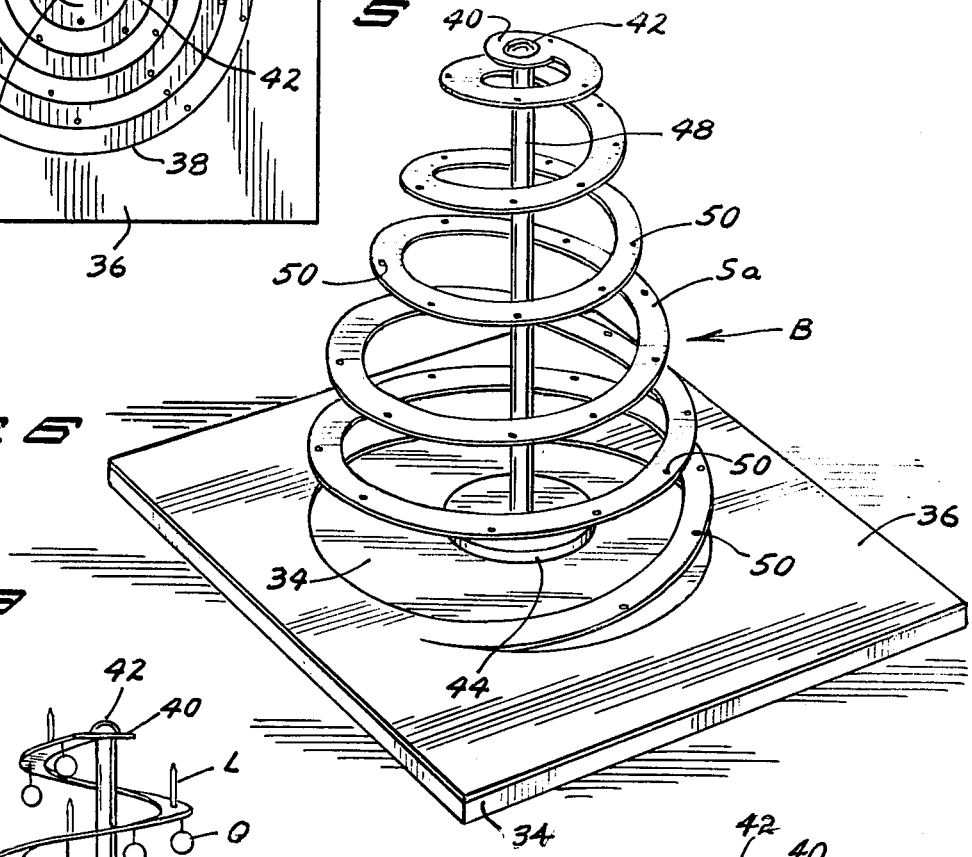
FIG. 6
FIG. 8
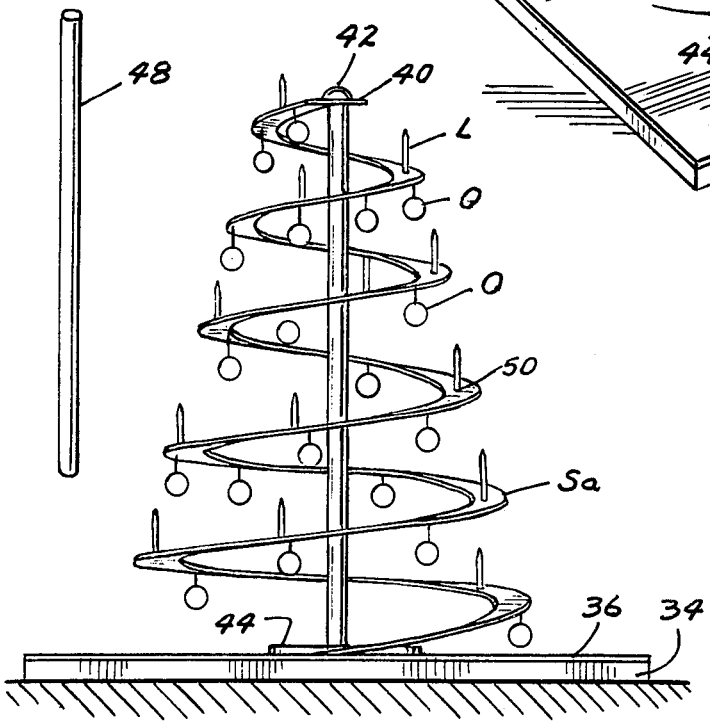
FIG. 7
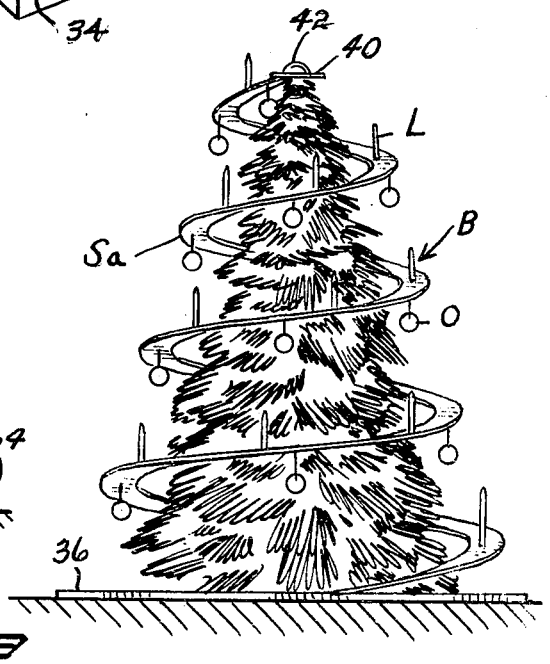
FIG. 9

SIMULATED EXTENDABLE AND COLLAPSIBLE EVERGREEN TREE

SUMMARY

The invention relates broadly to an improvement in simulated or artificial evergreen trees generally denoting the Christmas season. It is an object of the invention to provide a simulated evergreen formation formed as part of a Christmas greeting card in the form of a die cut spiral which may be pulled up from a flat condition and supported by a rod in tree-like formation. The tree formation is collapsed into completely flattened condition for storage.

The invention provides an evergreen tree formation that is easily and simply formed with a very minimal of material and cost and which is easily placed in operative condition or a collapsed condition. The tree formation includes means for attaching ornaments and lights thereto and has a hollow nature which may be set free standing or placed with ornaments and lights thereon upon a live growing tree for instant trimming of the live tree the base of the formation acting as a weight to hold the formation upon the live tree.

The invention will appear more clearly from the following detailed description when taken in connection with the accompanying drawings, showing by way of example a preferred embodiment of the inventive idea wherein like numerals refer to like parts throughout.

In the drawings forming part of this application:

FIG. 1 is a top plan view of an opened fold type greeting card showing the extendable and collapsible simulated tree formation in die cut flattened and collapsed condition as a part thereof and embodying the invention.

FIG. 2 is a perspective view of the card and tree formation of FIG. 1 with the tree formation in extended operable condition.

FIG. 2A is a cross-sectional view showing the card and tree formation of FIG. 1 in the folded condition.

FIG. 3 is a perspective view of the rod support for the tree formation.

FIG. 4 is a top plan view of a further embodiment of the invention simulating a floor standing evergreen tree in die cut flattened and collapsed condition.

FIG. 5 is a section on the line 5—5 of FIG. 4.

FIG. 6 is a perspective view of the tree formation of FIG. 4 with the tree formation in extended operable condition.

FIG. 7 is a sectional view on the line 7—7 of FIG. 6.

FIG. 8 is a perspective view of the rod support for the simulated tree formation of FIGS. 4–9.

FIG. 9 is an elevational view of the device illustrated as positioned about and supported by a living evergreen tree.

Referring to the drawings in detail, the greeting card with extendable and collapsible tree formation A includes the full sheet 10 divided by the fold line 12 which forms the first and second pages 14 and 16, respectively, and when folded page 14 directly overlies page 16 which acts as a base page particularly FIG. 2*a*.

Mounted on the inner face of the base page 16 is the flat support sheet 18. The sheet 18 is made of a relatively flexible material such as plastic, for example, has cut therethrough the cut 20 which starts at point "X" and which has a regular and ever decreasing diameter thereby forming the spiral cut and the ever decreasing elongated spiral piece S. The inner small end portion 22 of the spiral S has a raised portion thereby forming the socket 24. Further provided is a second socket 26 formed in the enlarged portion 28 formed on the page 16. The tree formation is manipulated into the operable form as in FIG. 2 by pulling upwardly on the end portion 22 so that it is spaced from the support sheet 18 sufficiently so that the relatively rigid rod 30 may be inserted at one end into the socket 26 with the other end of the rod inserted into socket 24 thereby supporting the spiral S in tree-like formation. The natural tendency of the spiral formation S to collapse due to gravity maintains the rod 30 in the sockets.

The tree-like formation is collapsed into flat condition so that it is contained between the pages 14 and 16 by simply removing the rod 30 from the sockets 24 and 26 whereby the formation falls automatically to the flattened compact condition of FIGS. 1 and 2*a* which is concealed by the cover page 14. The rod 30 may be stored in the fold 12.

A further embodiment of the invention is illustrated in FIGS. 4 – 9, and it is a floor standing collapsible and extendable simulated evergreen tree B. Included is the relatively broad flat base 34.

The numeral 36 designates a support sheet which has cut therethrough the cut 38 which starts at point "Y" and which has a regular and ever decreasing diameter thereby forming the spiral cut and the elongated spiral piece Sa. The sheet 36 is made of a relatively flexible material such as plastic, for example. The inner small end portion 40 of the spiral Sa has a raised portion thereby forming a first socket 42. The outer portions of the sheet 36 outwardly of the cut 38 are secured to the flat base 34 by adhesive or other conventional means. The sheet 36 may also act as a base as illustrated particularly in FIG. 9.

Further provided is the circular piece 44 secured to the top of the base 34 and centrally thereof. The circular piece 44 has formed therein in a second socket 46. Also provided is the relatively rigid rod 48. The device B is placed into the operable condition of FIGS. 6 and 7 by pulling upwardly on the end portion 40 so that it is spaced upwardly from the support sheet 36 sufficiently so that one end of the rod 48 may be inserted into the socket 46 with the other end of the rod inserted into socket 42. The natural tendency of the spiral formation Sa to collapse maintains the rod in the sockets 42 and 46.

The edges of the spiral formation Sa may be formed with spaced holes 50 in which ornaments o may be secured. Lights L may also be secured to the spiral with wires attached to and run down the spiral Sa to an electrical outlet source of power. Tinsel rope may be easily hung on the tree formation.

The spiral tree formation Sa may be collapsed into flat condition for storage in a minimal space by removing the rod 48 from the sockets whereby the formation falls automatically into the compact flattened condition of FIGS. 4 and 5. The ornaments, lights and other trim can be made of such a minimal dimension that the same may remain on the tree when collapsed.

In FIG. 9 the simulated tree formation is shown as placed upon a living evergreen for instant trimming of the tree, the weight and nature of the base 36 holding the tree formation downwardly extended upon the evergreen and the top of the tree holding the upper end 40 of the formation in extended condition.

Having thus described the invention, what is claimed as new and desired to be secured by Letters Patent is:

1. A display card having a simulated extendable and collapsible evergreen tree formation contained within the same comprising:

(a) a fold sheet divided by a fold line into a first page and (b) a second page, (c) a support sheet mounted on said second page which together with said second page forms a base, (d) said support sheet having a continuous cut formed therethrough starting at a point removed from the center of the support sheet and proceeding inwardly of the sheet in a circular formation in an ever decreasing diameter to form a spiral having flat upper and lower opposed surfaces and connected to the support sheet at one end with the other end free and having (e) a central formation on the free end, (f) a support rod, (g) said central formation having means for engagement of a first end of said rod, (h) said support sheet having means carried thereby for engagement with the second end of said support rod, (i) said first end of said support rod engaged in said engagement means of said central formation and said second end of said support engaged in said engagement means carried by said support sheet supporting said spiral in extended fixed condition with said flat surfaces of said spiral being substantially normal to the axis of the support rod and substantially parallel to the flat support sheet, the removal of said support rod causing said spiral to assume a flattened collapsed condition upon said second page and upon which said first page is positioned for protection and concealment of the spiral.

2. An extendable and collapsible lighted decoration for a standing evergreen tree comprising:

(a) a flat support sheet, (b) said sheet having a cut formed therethrough starting at a point removed from the center of the support sheet and proceeding inwardly of the sheet in a circular formation in an ever decreasing diameter to form a spiral having upper and lower opposed flat surfaces and connected to the sheet at one end with the other end free, said flat surfaces of said spiral being substantially normal to the longitudinal axis of the spiral in extended condition, (c) means on the free end of the spiral for engagement with the upper end of a standing evergreen tree with the spiral of a length when extended downwardly about the tree axially thereof to allow the support sheet to rest upon the ground and hold the spiral in extended condition about the tree, and (d) electric lights mounted on said spiral thereby providing a standing evergreen tree with lighted decoration.

* * * * *